US009238893B2

(12) United States Patent
Latham

(10) Patent No.: US 9,238,893 B2
(45) Date of Patent: Jan. 19, 2016

(54) TOOTH AND RETAINER FOR A MILLING DRUM

(71) Applicant: Winchester E. Latham, Avon, IN (US)

(72) Inventor: Winchester E. Latham, Avon, IN (US)

( * ) Notice: Subject to any disclaimer, the term of this patent is extended or adjusted under 35 U.S.C. 154(b) by 28 days.

(21) Appl. No.: 13/975,704

(22) Filed: Aug. 26, 2013

(65) Prior Publication Data

US 2015/0054332 A1 Feb. 26, 2015

(51) Int. Cl.

| | |
|---|---|
| ***E01C 23/088*** | (2006.01) |
| ***E01C 23/12*** | (2006.01) |
| ***E21C 25/10*** | (2006.01) |
| ***E21C 35/193*** | (2006.01) |
| ***B28D 1/18*** | (2006.01) |

(52) U.S. Cl.

CPC ..... *E01C 23/088* (2013.01); *B28D 1/188* (2013.01); *E01C 23/127* (2013.01); *E21C 25/10* (2013.01); *E21C 35/1933* (2013.01)

(58) Field of Classification Search

CPC .... B27G 13/041; B02C 18/145; B02C 18/18; B23C 5/2455; B23C 2210/168; B23C 5/20; A01F 29/095; E21C 35/19; E21C 25/10; E21C 35/18; E21C 35/1933; E01C 23/06; E01C 23/127; B28D 1/181; B28D 1/186; B28D 1/188

USPC ..... 299/36.1, 39.1, 39.3, 39.4, 39.7, 39.8, 299/87.1, 102, 106

See application file for complete search history.

(56) References Cited

U.S. PATENT DOCUMENTS

| | | | | | |
|---|---|---|---|---|---|
| 2,306,798 | A | * | 12/1942 | Benninghoff | 407/38 |
| 3,574,251 | A | * | 4/1971 | Corti | 407/45 |
| 4,009,742 | A | * | 3/1977 | Ziegelmeyer | 144/230 |
| 4,880,278 | A | * | 11/1989 | Tomlinson | 299/112 R |
| 5,066,180 | A | * | 11/1991 | Lang et al. | 411/103 |
| 5,529,249 | A | * | 6/1996 | Braun et al. | 241/32 |
| 5,857,506 | A | * | 1/1999 | Paolone | 144/230 |
| 5,884,979 | A | | 3/1999 | Latham | |
| 6,427,791 | B1 | * | 8/2002 | Glowka et al. | 175/413 |
| 7,108,212 | B2 | | 9/2006 | Latham | |
| 7,290,726 | B2 | | 11/2007 | Latham | |
| 7,338,134 | B2 | | 3/2008 | Latham | |
| 2001/0045478 | A1 | * | 11/2001 | Recker et al. | 241/294 |
| 2008/0175686 | A1 | * | 7/2008 | Wallek | 411/44 |

* cited by examiner

*Primary Examiner* — John Kreck
*Assistant Examiner* — Carib Oquendo
(74) *Attorney, Agent, or Firm* — Brinks Gilson & Lione

(57) ABSTRACT

A milling drum adapted to be rotated in a cutting direction about an axis defined by the cylindrical surface of the drum. A plurality of pairs of overlapping recesses in the cylindrical surface of the drum. A tooth or cutting bit with a base configuration matching a first of the pair of the overlapping recesses, and a lower portion of a side surface including a retainer engagement feature. A retainer has a base configuration matching a second of the pair of overlapping recesses, and a side surface including a tooth engagement feature. A fastener secures the retainer in the second of the overlapping recesses so that the tooth engagement feature of the retainer engages the retainer engagement feature of the tooth or cutting bit to hold the tooth or cutting bit in the first of the overlapping recesses.

19 Claims, 6 Drawing Sheets

TOOTH AND RETAINER FOR A MILLING DRUM

BACKGROUND

This invention generally relates to the field of rotary driven cylindrical cutter devices and scarifiers for use in roadway surface milling. More particularly, the present invention is directed to tooth and retainer inserts for such rotary driven cylindrical cutter devices and scarifiers that can be used on equipment for modifying the surface of an existing road, and in particular, to equipment for smoothing areas of existing pavement by removing bumps, upward projections, and other surface irregularities, removing paint stripes, and milling shallow recessed to receive roadway edging and marking tape.

In general, roadway surface milling, planing, or reclaiming equipment disclosed in the prior art includes a rotary driven cylindrical comminuting drum which acts to scarify and to mine the top portion of the asphaltic road surface in situ. Road planning machines are used to remove bumps and other irregularities on the surface of a road, runway, taxiway, or other stretch of pavement. This planning effect is typically achieved by grinding the paved surface so that the grinding depth may vary slightly, but the surface produced by the grinding unit is more level than the original surface. The road planning machine typically includes a grinding unit that is powered by an engine or motor. A tractor is attached to, or integral with, the grinding unit for propelling the grinding unit against the paved surface in a desired direction.

In some prior art devices of this type, a plurality of cutter bit support members are connected by bolts or by a weld to the curved surface of a drum or to flighting fixed to a drum surface. The plurality of the support members can be arranged end-to-end so as to form a more or less continuous helical pattern. The top surface of the helically arranged support members may be elevated above the curved surface of the drum. The top surfaces of the cutter bit support members can include angled openings into which conventional cutter bits are received. The cutter bits can be a conical cutter with preferably a tungsten carbide tip or the like. The tip can have a variety of shapes.

One example of a cutter bit holder and drum is disclosed in U.S. Pat. No. 5,884,979 to Latham. Here, the drum surface omits any flighting, but includes a plurality of spaced recesses arranged in a preselected pattern, each recess being defined by a generally circular upper edge and including a bottom surface depressed below the driven member rotatable surface. Each cutting bit holding element has a body portion having at least one aperture receiving the cutting bit and a lower portion having a generally cylindrical outer surface sized to be received in only one of said recesses. The lower portion has a reference lower end abutting the recess bottom surface with a locating element engaging the cutting bit holder element lower end with a niche within said recess for orienting the cutting bit holder with respect to said cutting direction. When the cutting bit holding elements are situated within the recesses, they are secured in position by means of a weld line joining the cutting bit holding element to the surface of the drum in a line outside of the upper edge of each recess. In the event of wear or catastrophic failure of one or more of the cutting bit holding elements, the worn or failed element must be removed from the assembly. Replacement of the holding element requires the use of a cutting torch, and the welding of a new support member in place. This is a time-consuming repair job which results in considerable expense to a mining machine operation, and results in a decreased rate in mining.

Despite the availability of such devices, there exists a need in the art for an apparatus having a cutter bit insert for a milling drum, preferably without flighting, that is capable of removable attachment to the drum, yet is resistant to loosening upon rotation of the milling drum. There is also a need for a cutter bit a cutter bit having low profile above the drum so that the total diameter of the drum including cutter bits is less than about 18 inches. There is also a need for a cutter bit that can be quickly removed from the drum and replaced so that the down time experience during cutter bit replacement is minimized.

SUMMARY

A combination can be used on any selected portion of a milling or planning drum that preferably omits any flighting and is adapted to be rotated in a cutting direction about an axis defined by the cylindrical surface of the drum. The combination includes a plurality of pairs of overlapping recesses in the cylindrical surface of the drum. The combination can also include a tooth or cutting bit having a base configuration matching a first of the pair of the overlapping recesses, and a lower portion of a side surface including a retainer engagement feature. The combination can also include a retainer having a base configuration matching a second of the pair of overlapping recesses, and a side surface including a tooth engagement feature. A fastener can secure the retainer in the second of the pair of overlapping recesses so that the tooth engagement feature of the retainer engages the retainer engagement feature of the tooth or cutting bit.

The combination can include a drum wherein each of the pairs of overlapping recesses includes side surfaces that are parallel to each other. In a preferred embodiment, each of the pairs of overlapping recesses can be aligned along a circumference line extending around the cylindrical surface of the drum. The combination can also include a retainer engagement feature on the lower portion of a side surface of the tooth which comprises an inclined planar surface facing outwardly relative to the drum cylindrical surface. The combination can also include a tooth engagement feature on the retainer which comprises an inclined planar surface facing inwardly relative to the drum cylindrical surface. In a preferred embodiment, the inclined planar surface on the side surface of the tooth is angled to be abutted by the inclined planar surface of the retainer to lock the tooth into the first of the overlapping recesses in the drum.

The combination can also include a retainer wherein the fastener comprises a screw passing through the retainer so that the fastener is engaged into a threaded opening in the base of the second of the pair of overlapping recesses. In a preferred embodiment, the retainer includes a hole passing through the retainer in alignment with the threaded opening in the base of the second of the pair of overlapping recesses, the hole having a diameter greater than the threaded opening in the base, the hole having an internal engagement feature. The internal engagement feature of the hole in the retainer can be design to engage an extraction tool. The extraction tool can take the form of a slide hammer including a shaft and a slide weight, the shaft having an end adapted to engage the engagement feature of the hole in the retainer to pull the retainer and tooth from the overlapping recesses. Alternatively, the extraction tool can take the form of a threaded extraction screw having a diameter greater than the fastener diameter that engages the engagement feature of the hole in the retainer, so that an end of the extraction screw abuts a surface within the second of the pair of overlapping recesses to push the retainer and tooth from the overlapping recesses.

One feature of the apparatus is that the retainer can be sized to have an upper surface that is situated below the cylindrical surface of the drum when the retainer and tooth are fully engaged in the overlapping recesses. The feature has the advantage of substantially eliminating any wear on the sides of the retainer so that the retainer can be used repeatedly with new teeth or cutting bits, thereby lowering hardware replacement costs.

Another feature of the apparatus is that the upper end of the cutting bit or tooth can have any desired configuration, including a broad flat chisel point particularly suitable for roadway surface milling and planing equipment intended for modifying the surface of an existing road, and in particular, to equipment for smoothing areas of existing pavement by removing bumps, upward projections, and other surface irregularities. A particular advantage of this combination is the ability to form rotary driven cylindrical cutter devices of small diameter.

Another feature of the apparatus is that the threaded opening in the base receiving the retainer can be defined by a removable insert having internal threads designed to engage the fastener securing the retainer in place. The removable character of the insert ensures that the drum can quickly be refurbished in the field, if necessary, in the event of any damage to the fastener engaging threads.

These and other advantages of the disclosed combination will become readily apparent to those skilled in the art from the following detailed description of a preferred embodiment when considered in the light of the accompanying drawings.

DESCRIPTION OF PREFERRED EMBODIMENTS

Figure 1:
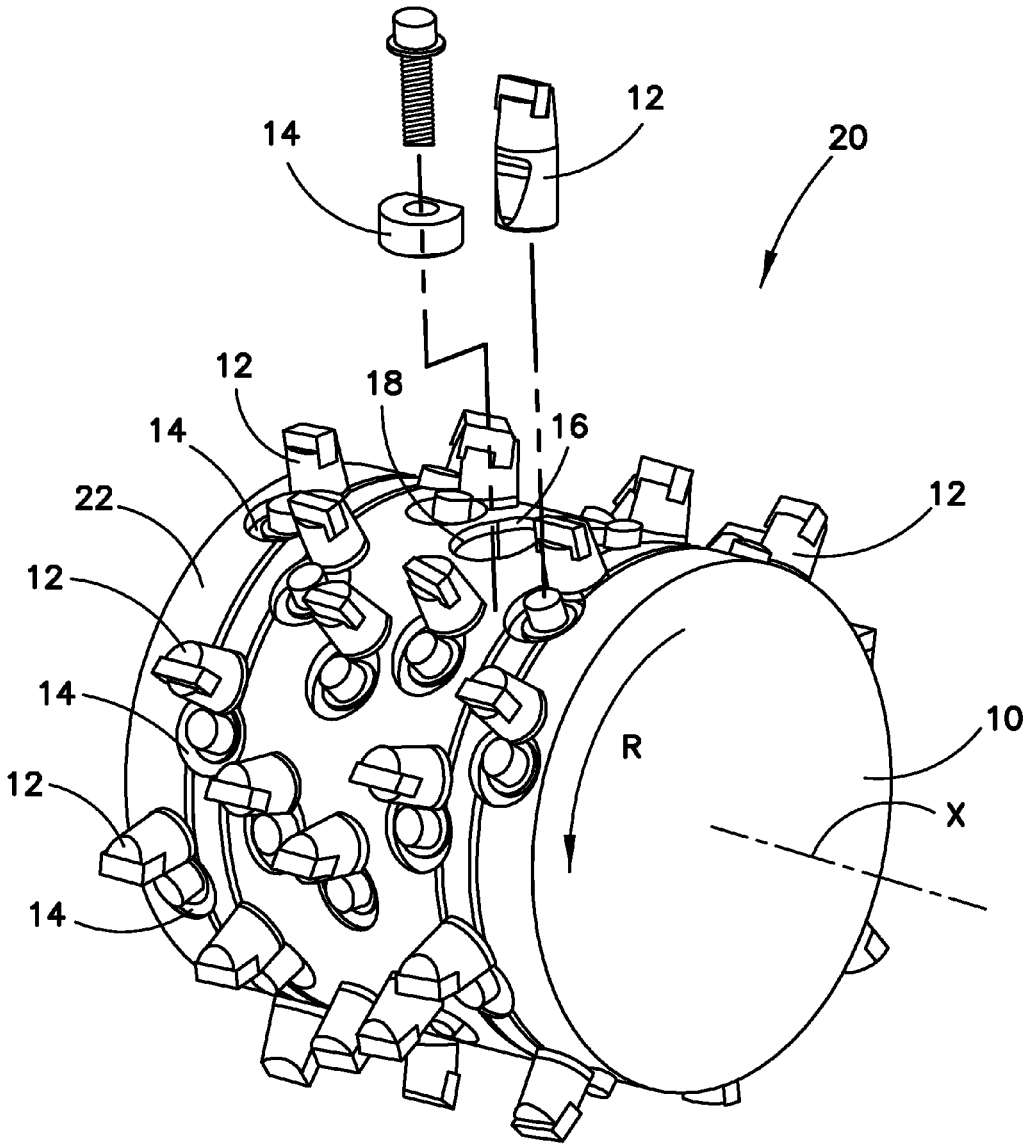
FIG. 1 is a perspective view of a drum having a plurality of cutting bit and retainer pairs received in overlapping recesses, one of the cutting bit and retainer pairs shown in exploded view.

With reference to all the drawings, the same reference numerals are generally used to identify like components. FIG. 1 is a perspective view of a drum 10 without flighting having a plurality of cutting bit 12 and retainer 14 pairs received in overlapping recesses 16, 18 in the drum 10. The recesses 16 and 18 are shown in FIG. 1 to consist of overlapping right cylindrical depressions into the drum 10. One of the cutting bit and retainer pairs is shown in exploded view to illustrate one embodiment of an apparatus 20. The cutting bit and retainer pairs can be used on any portion of a cylindrical surface 22 of a milling or mining drum 10, which is adapted to be rotated in a cutting direction R about a cylindrical axis X concentric to the drum surface 22.

Figure 2:
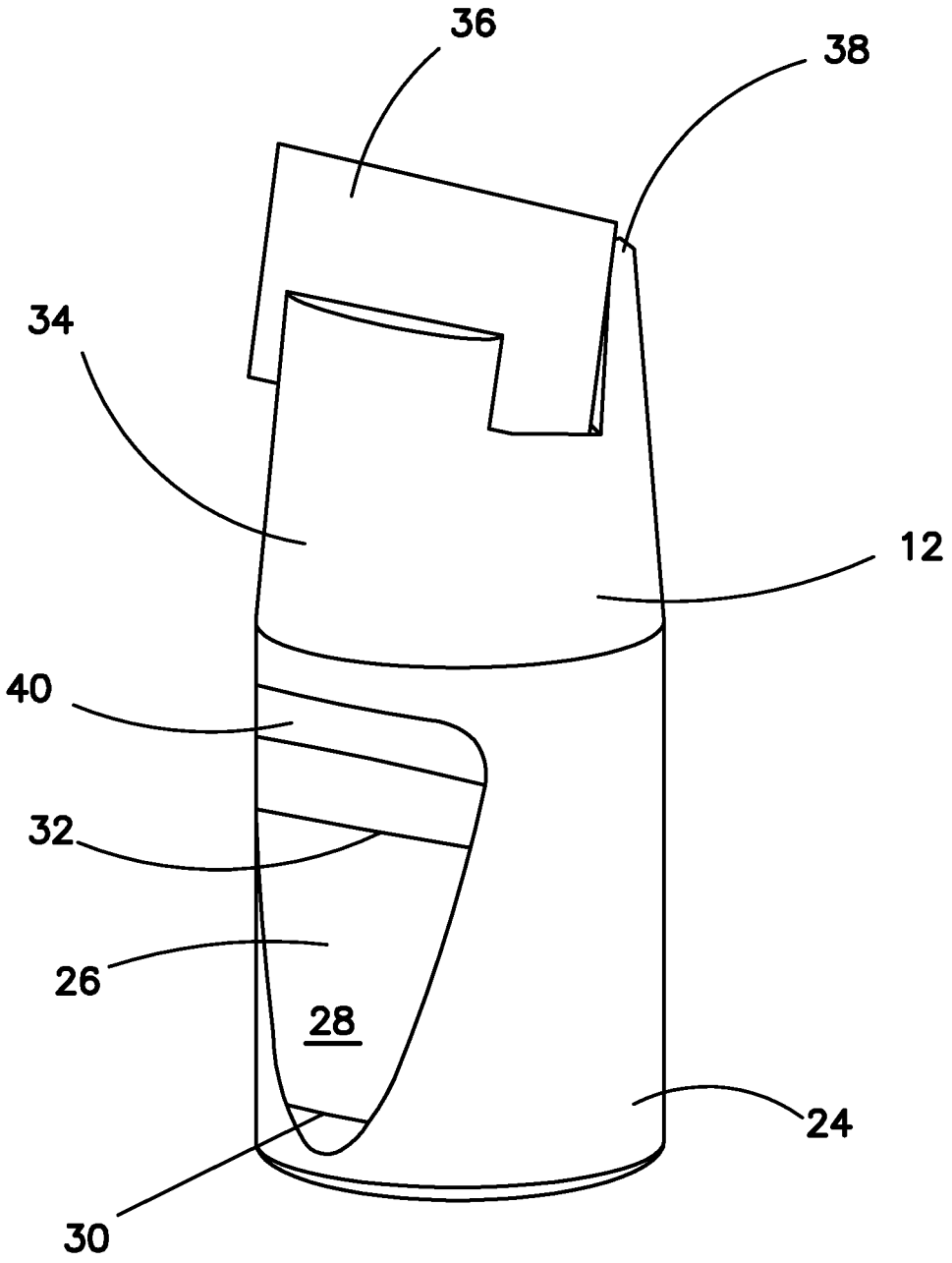
FIG. 2 is an enlarged, perspective view of one of the cutting bits showing a retainer engagement feature on a lower portion of the cutter bit.

One embodiment of the cutting bit 12 is shown in FIG. 2 to include a pedestal 24 that is shown to be generally cylindrical and includes a retainer engagement feature 26 on a lower portion thereof. The retainer engagement feature 26 is shown as a planar surface 28 that is inclined slightly upwardly so that a lower chord line 30 on the surface is shorter than a parallel upper chord line 32. The cutting bit 12 is also shown in FIG. 2 to include a upper portion 34 that is shown to be conically tapered, but the upper portion 34 can be a continuation of the shape of the pedestal 24. A cutting element 36 can be secured to protrude above an upper end 38 of the conically tapered upper portion. The cutting bit 12 is further shown in FIG. 2 to have an additional laterally extending surface 40 located immediately above the retainer engagement feature 26 that facilitates the removal of the cutting bit 12 from the drum 10 as described below.

Figure 3:
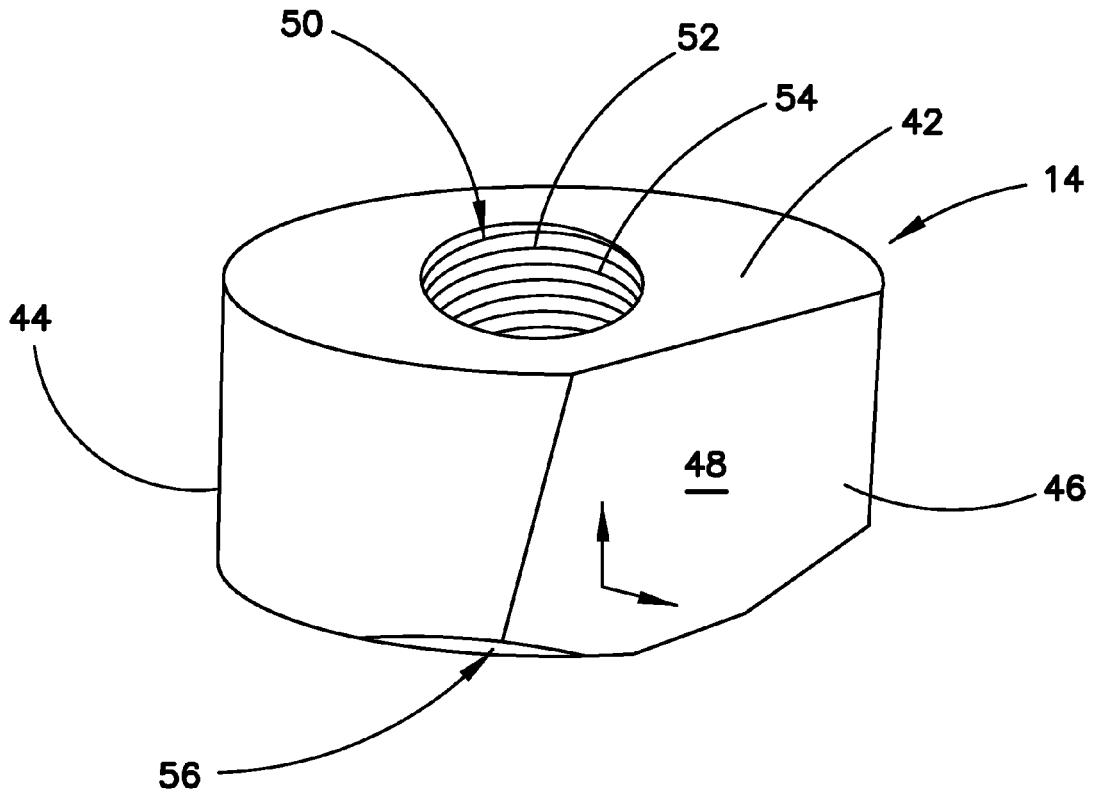
FIG. 3 is an enlarged, perspective view of one of the retainers showing a tooth engagement feature on a side thereof.

One embodiment of the retainer 14 is shown in FIG. 3 to include a planar upper surface 42 that is perpendicular to a right cylindrical side surface 44. A tooth engagement feature 46 occupies a portion of the side of the retainer 14 and is shown to consist of a planar surface 48 inclined slightly downwardly at an angle matching, but in the opposite direction of, planar surface 28 on cutting bit 12. The retainer 14 also includes a hole 50 passing through the retainer 14 perpendicular to the upper planar surface 42 and symmetrically positioned with respect to the right cylindrical side surface 44. The hole 50 can include an internal engagement feature 52, which can be a set of threads 54, adapted to engage a tool suitable for removing the retainer 14 from the drum 10 as discussed in more detail below. The retainer 14 also can include a tapered lower surface 56, which may be better see in FIG. 4.

Figure 4:
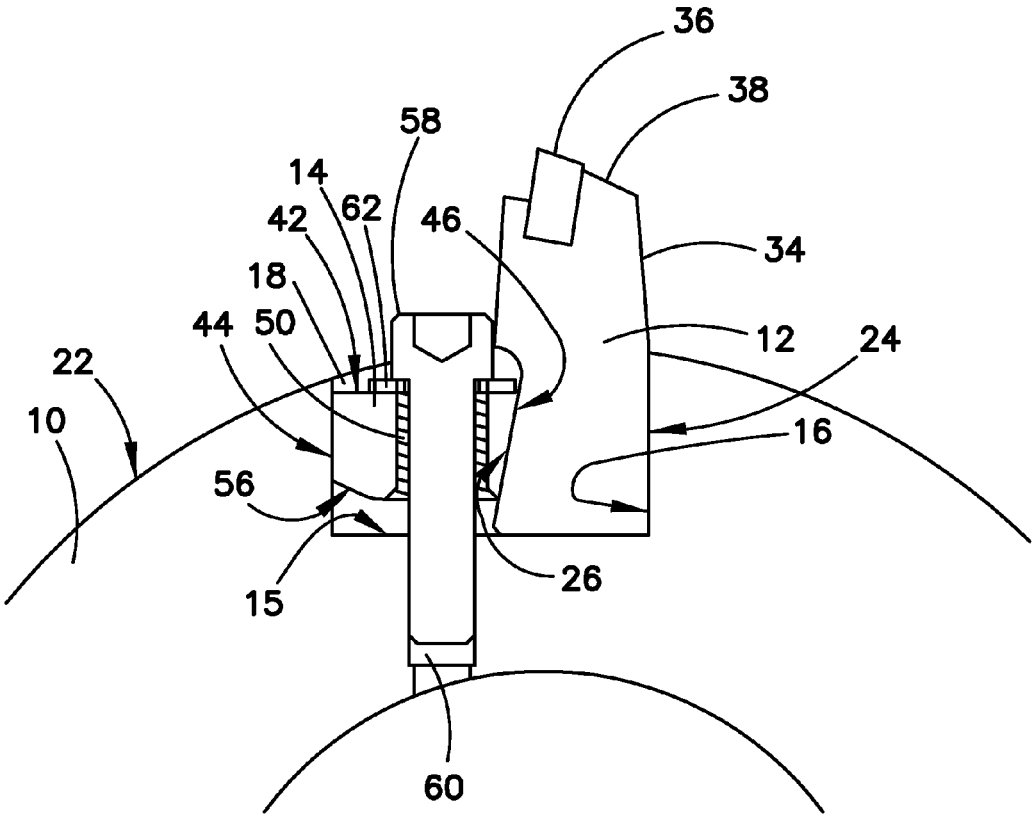
FIG. 4 is a sectional view of a drum with one of the cutting bit and retainer pairs received in overlapping recesses.

FIG. 4 is a sectional view of a drum 10 with one of a cutting bit 12 received in recess 16 and retainer 14 received in recess 18. The cylindrical pedestal portion 24 of the cutting bit 12 is shown to be dimensioned to match the size of the recess 16, while the upper portion 34 extends above the surface 22 of the drum 10. The cylindrical side surface 44 of the retainer 14 is dimensioned to match the size of the recess 18, while the vertical dimension of the retainer is such that the planar upper surface 42 is recessed below the surface 22 of the drum 10. The tooth engagement feature 46 of the retainer 14 engages in an abutting arrangement the retainer engagement feature 26 of the tooth or cutting bit 12. A fastener 58, which can be a screw, can secure the retainer 14 in the recess 18 so that the tooth engagement feature 46 engages the retainer engagement feature 26 to lock the cutting bit 12 in a desired position with respect to the drum surface 22. The fastener 58 is preferably of a smaller diameter than hole 50 so that the fastener passes freely through the hole to engage an opening 60 in the bottom 15 of recess 14. The fastener 58 can include a washer 62 to provide a broad bearing surface on the top of the planar upper surface 42 of the retainer 14.

Figure 5:
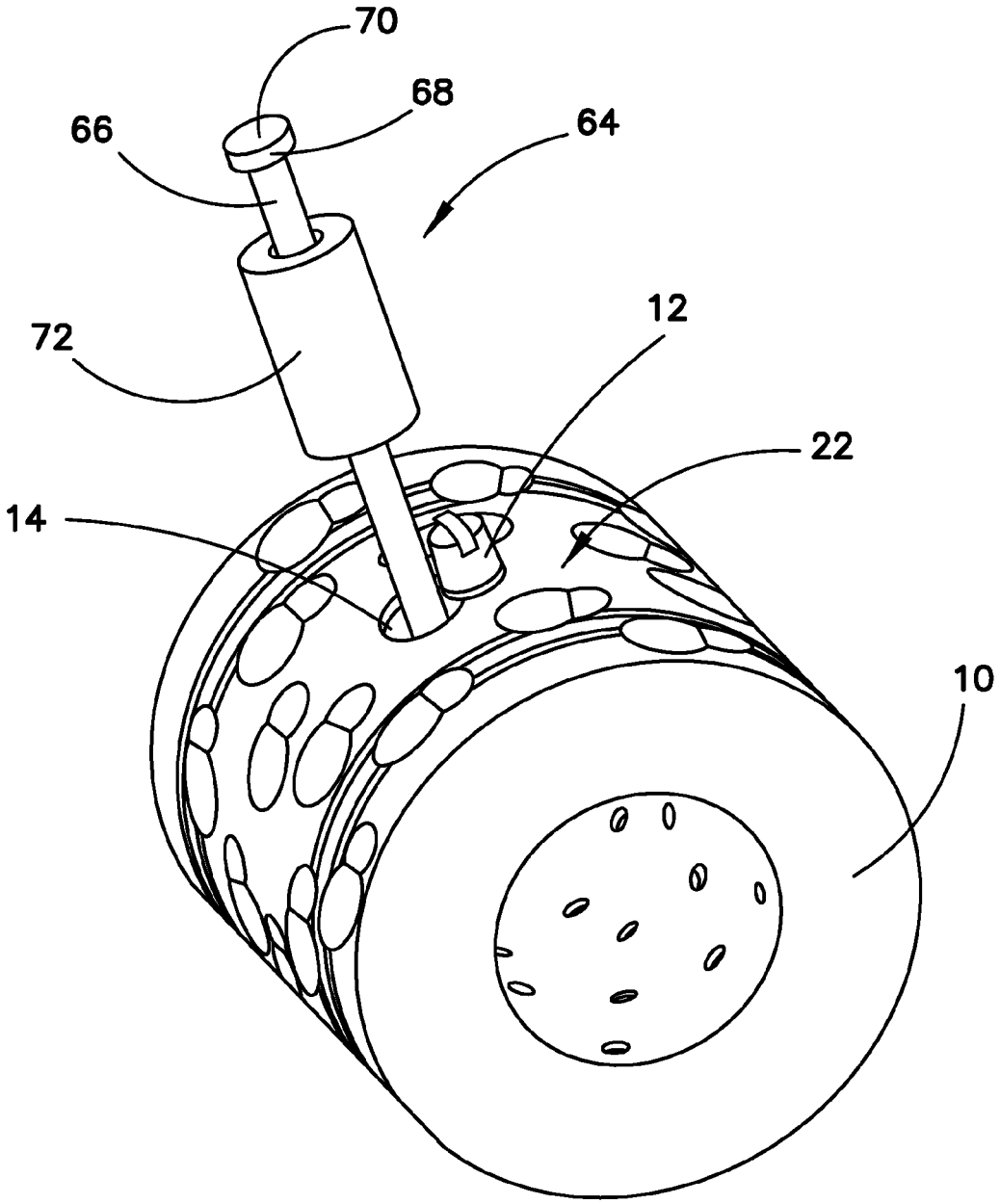
FIG. 5 is a perspective view of a drum with a slide hammer engaged into a retainer to extract the retainer and associated cutting bit from the drum.

FIG. 5 is a perspective view of a drum 10 with a slide hammer 64 engaged into hole 50 of retainer 14 to extract the retainer 14 and associated cutting bit 12 from the drum 10. The slide hammer 64 includes a shaft 66 having a lower end engaging hole 50 of the retainer 14 and an upper end 68 including an enlarged head 70. A slide weight 72 is situated on the shaft 66 so as to be reciprocally movable along the shaft, and, in particular, to repeatedly impact the enlarged head 70. The repeated impact will act to extract the retainer 14 from the recess 18. As the retainer 14 moves outward, an edge of the planar upper surface 42 of the retainer 14 will come in contact with the laterally extending surface 40 located immediately above the retainer engagement feature 26. Consequently, the outward movement of the retainer 14 forces the associated cutting bit 12 from the drum 10.

An alternative to the use of an slide hammer 64 is the engagement of an elongated extraction screw, not shown, in the hole 50 of retainer 14. The elongated extraction screw can have a lower end designed to abut the bottom 15 of recess 18. An impact wrench, or other tool, can then advance the extraction screw, which advance has the effect of backing the retainer 14 out of recess 18. As the retainer 14 moves outward, an edge of the planar upper surface 42 of the retainer 14 comes into contact with the laterally extending surface 40 located immediately above the retainer engagement feature 26. Consequently, the outward movement of the retainer 14 forces the associated cutting bit 12 from the drum 10.

Figure 6:
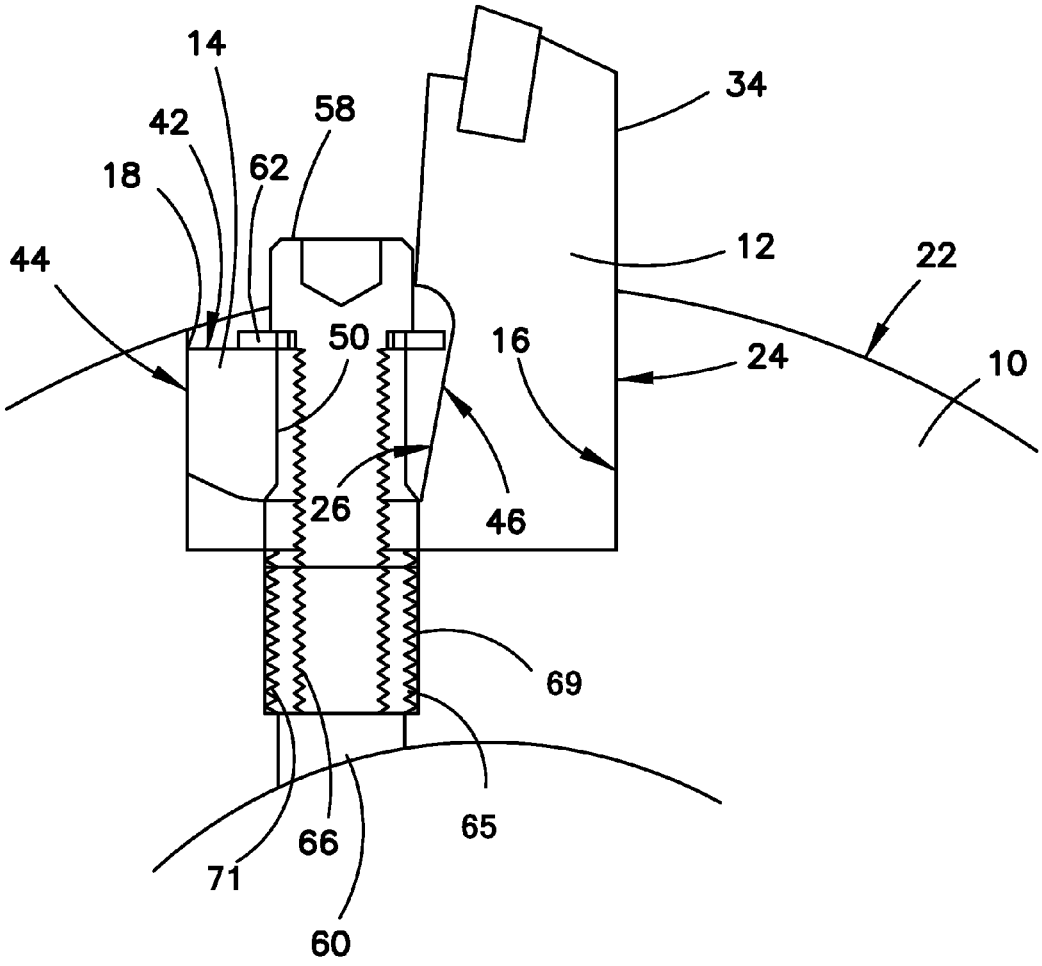
FIG. 6 is a sectional view of a drum similar to FIG. 4 showing a removable insert having internal threads designed to engage the fastener securing the retainer in place.

FIG. 6 is a sectional view of a drum 10 similar to FIG. 4 showing a removable insert 65 having internal threads 66 designed to engage the fastener 58 securing the retainer 14 in place in the recess 18. The removable insert 65 can have an outer engagement surface 69 designed to cooperatively engage a corresponding interior engagement surface 71 in opening 60. The cooperatively engaging surfaces 69 and 71 can be, for example, threads, preferably of a different pitch than the internal threads 66 engaging the fastener 58, and possibly of a hand opposite that of the internal threads 66. The removable character of the insert 65 ensures that the drum 10 can quickly be refurbished in the field, if necessary, in the event of any damage to the fastener engaging threads 66. This avoids the necessity of having to possibly re-tap the threads of opening 60 shown in FIG. 4 in the event of damage to the threads. As in FIG. 4, the pedestal portion 24 of the cutting bit 12 is shown to be dimensioned to match the size of the recess 16, while the upper portion 34 extends above the surface 22 of the drum 10. The side surface 44 of the retainer 14 is dimensioned to match the recess 18, while the vertical dimension of the retainer is such that the planar upper surface 42 is recessed below the surface 22 of the drum 10. The tooth engagement feature 46 of the retainer 14 engages in an abutting arrangement the retainer engagement feature 26 of the tooth or cutting bit 12. The fastener 58 can secure the retainer 14 in the recess 18 so that the tooth engagement feature 46 engages the retainer engagement feature 26 to lock the cutting bit 12 in a desired position with respect to the drum surface 22. The fastener 58 passes freely through the hole 50 in the retainer 14 to engage the internal threaded portion 66 of removable insert 65. The fastener 58 can include a washer 62 to provide a broad bearing surface on the top of the planar upper surface 42 of the retainer 14.

It will be noted from FIGS. 1, 5 and 6 that the diameter of the retainer receiving recess 18 is greater than the diameter of the cutting bit receiving recess 16. The relative sizes of the recesses are a matter of design choice, and the relative sizes can be reversed or maintained equal. It will also be noted from FIGS. 1, 5 and 6 that the recesses are cylindrical in shape, but again this is a matter of design choice, and other shapes might be used for either or both of the recesses 16, 18, so long as the pedestal 24 of the cutting bit 12 and the retainer 14 are suitably shaped to correspond to the shape and size of the recesses 16, 18. It will also be noted from FIGS. 1, 5 and 6 that the recesses 16, 18 are aligned along a circumference line extending around the cylindrical surface 22 of the drum 10, with the retainer 14 in advance of the cutting bit 12. The relative position of the retainer 14 and cutting bit 12 is a matter of design choice. The retainer could be positioned behind or beside the cutting bit so long as the retainer engagement surface 26 and the laterally extending surface 40 on the cutting bit 12 were suitably repositioned. It will be noted from FIGS. 1, 2, and 4 that the cutting bit 12 includes a cutting element 36 having an broad upper edge generally parallel to the surface 22 and having a negative rake angle with respect to the cutting direction of drum 10. The configuration of the cutting element 36 is also a matter of design choice, and the cutting element can have any desired configuration that is thought to be particularly suitable for the intended use.

The foregoing detailed description should be regarded as illustrative rather than limiting, and the following claims, including all equivalents, are intended to define the spirit and scope of this invention

The invention claimed is:

1. A combination of a cylindrical surface of a milling drum, adapted to be rotated in a cutting direction about an axis concentric to the cylindrical surface and additional apparatus, the combination comprising:

a plurality of pairs of overlapping recesses in the cylindrical surface, each of the overlapping recesses extending into the milling drum a predetermined distance defined by a surrounding wall and a floor formed by the milling drum;

a tooth or cutting bit having a base configuration matching a first of the pair of the overlapping recesses, and a lower portion of a side surface of the base configuration includes a retainer engagement feature, wherein the base configuration abuts and is contiguously aligned with the floor formed by the milling drum so that a cutting element positioned at an upper end of the tooth or cutting bit extends away from the cylindrical surface to form a negative rake angle with respect to the cutting direction of the milling drum, the tooth or cutting bit further comprising a conically tapered upper portion comprising a slot formed at the upper end to receive the cutting element, the slot having a slot length that is greater than a slot width, wherein the cutting element is disposed in the slot so that a portion of the upper end forms a lip extending above a bottom edge of the cutting element;

a retainer having a base configuration matching a second of the pair of overlapping recesses, and a side surface including a tooth engagement feature; and a fastener securing the retainer in the second of the pair of overlapping recesses so that the tooth engagement feature of the retainer engages the retainer engagement feature of the tooth or cutting bit and fixedly retains the tooth or cutting bit in contiguous alignment with the floor.

2. The combination of claim 1, wherein each of the pairs of overlapping recesses includes side surfaces that are parallel to each other.

3. The combination of claim 1, wherein the fastener comprises a screw passing through the retainer and engaged into a threaded opening in the second of the pair of overlapping recesses.

4. The combination of claim 3, further comprising a replaceable insert fixed in the base of the second of the pair of overlapping recesses, and wherein the threaded opening is located in the replaceable insert.

5. The combination of claim 4, wherein the replaceable insert has a threaded outer surface having a pitch different from the pitch of the threaded opening in the insert.

6. The combination of claim 3, wherein the retainer includes a hole passing through the retainer in alignment with the threaded opening in the second of the pair of overlapping recesses, the hole having a diameter greater than the threaded opening in the base and an internal engagement feature to engage an extraction tool.

7. The combination of claim 1, wherein each pair of overlapping recesses are aligned along a circumference line extending around the cylindrical surface of the drum.

8. The combination of claim 7, wherein the second of the pair of overlapping recesses is positioned ahead of the first of the pair of overlapping recesses in relation to the cutting direction of rotation of the drum.

9. The combination of claim 1, wherein the cutting element is disposed in the slot so that a cutting edge of the cutting element is aligned substantially parallel to the axis concentric to the cylindrical surface.

10. The combination of claim 1, wherein the diameter of the milling drum is less than about 18 inches.

11. A combination of a cylindrical surface of a milling drum, adapted to be rotated in a cutting direction about an axis concentric to the cylindrical surface and additional apparatus, the combination comprising:

a plurality of pairs of overlapping recesses in the cylindrical surface, each of the overlapping recesses extending into the milling drum a predetermined distance defined by a surrounding wall and a floor formed by the milling drum;

a tooth or cutting bit having a base configuration matching a first of the pair of the overlapping recesses, and a lower portion of a side surface of the base configuration includes a retainer engagement feature, wherein the base configuration abuts and is contiguously aligned with the floor formed by the milling drum so that a cutting element positioned at an upper end of the tooth or cutting bit extends away from the cylindrical surface to form a negative rake angle with respect to the cutting direction of the milling drum;

a retainer having a base configuration matching a second of the pair of overlapping recesses, and a side surface including a tooth engagement feature, wherein the retainer engagement feature on the lower portion of the side surface of the tooth comprises an inclined planar surface facing outwardly relative to the drum cylindrical surface, the inclined planar surface being inclined upwardly so that a lower cord line on the inclined planar surface is shorter than an upper chord line that is parallel with the lower chord line; and a fastener securing the retainer in the second of the pair of overlapping recesses so that the tooth engagement feature of the retainer engages the retainer engagement feature of the tooth or cutting bit and fixedly retains the tooth or cutting bit in contiguous alignment with the floor.

12. The combination of claim 11, wherein the tooth engagement feature on the retainer comprises an inclined planar surface facing inwardly relative to the drum cylindrical surface.

13. The combination of claim 11, wherein the retainer engagement feature on the lower portion of the side surface of the tooth additionally comprises an laterally extending surface at an outer end of the inclined planar surface that overlaps an upper edge of the retainer.

14. A combination of a cylindrical surface of a milling drum, adapted to be rotated in a cutting direction about an axis concentric to the cylindrical surface and additional apparatus, the combination comprising:

a plurality of pairs of overlapping recesses in the cylindrical surface, each of the overlapping recesses extending into the milling drum a predetermined distance defined by a surrounding wall and a floor formed by the milling drum;

a like plurality of teeth, each having a base configuration matching a first of the pair of the overlapping recesses, and a lower portion of a side surface including a retainer engagement feature, each of the teeth being positioned in one of the first of the overlapping recesses, wherein the base configuration abuts and is contiguously aligned with the floor formed by the milling drum so that a cutting element positioned at an upper end of the tooth or cutting bit extends away from the cylindrical surface to form a negative rake angle with respect to the cutting direction of the milling drum, wherein each of the like plurality of teeth further comprising a conically tapered upper portion opposite the base configuration, the upper portion comprising a slot formed in the upper portion to receive the cutting element, the slot having a slot length that is greater than a slot width, wherein the cutting element is disposed in the slot so that a portion of the upper portion forms a lip extending above a bottom edge of the cutting element;

a plurality of retainers, each retainer having a base configuration matching a second of the pair of overlapping recesses, a side surface of each retainer including a tooth engagement feature, and a hole passing through each retainer in alignment with a threaded opening in the second of the pair of overlapping recesses, the hole having a diameter greater than the threaded opening and having an internal engagement feature; and a plurality of fasteners each passing through the hole in one of the retainers to secure the retainer in one of the second of the pairs of overlapping recesses so that the tooth engagement feature of the retainer engages the retainer engagement feature of each tooth.

15. The combination of claim 14, wherein the retainer engagement feature on the lower portion of the side surface of each tooth comprises a laterally extending surface that overlaps an upper edge of the adjacent retainer.

16. The combination of claim 14, further comprising a replaceable insert fixed in the floor of each of the second of the pair of overlapping recesses, and wherein the threaded opening is located in the replaceable insert.

17. The combination of claim 14, wherein each of the pairs of overlapping recesses includes side surfaces that are parallel to each other, wherein the retainer engagement feature on the lower portion of the side surface of each tooth comprises an inclined planar surface facing outwardly relative to the drum cylindrical surface, and wherein the retainer engagement feature on the lower portion of the side surface of each tooth additionally comprises a laterally extending surface at an outer end of the inclined planar surface that overlaps an upper edge of the adjacent retainer.

18. The combination of claim 17, wherein the tooth engagement feature on each retainer comprises an inclined planar surface facing inwardly relative to the drum cylindrical surface.

19. The combination of claim 14, wherein each pair of overlapping recesses are aligned along a circumference line extending around the cylindrical surface of the drum, and the second of each pair of overlapping recesses is positioned ahead of the first of each pair of overlapping recesses in relation to the cutting direction of rotation of the drum.

* * * * *